US011045701B2

(12) United States Patent
Ozden

(10) Patent No.: US 11,045,701 B2
(45) Date of Patent: Jun. 29, 2021

(54) COMPACT RETRACTABLE GOLF CLUB HOLDER

(71) Applicant: Brian A. Ozden, Evans, GA (US)

(72) Inventor: Brian A. Ozden, Evans, GA (US)

( * ) Notice: Subject to any disclaimer, the term of this patent is extended or adjusted under 35 U.S.C. 154(b) by 116 days.

(21) Appl. No.: 16/458,177

(22) Filed: Jun. 30, 2019

(65) Prior Publication Data

US 2020/0001153 A1 Jan. 2, 2020

Related U.S. Application Data

(60) Provisional application No. 62/692,671, filed on Jun. 30, 2018.

(51) Int. Cl.

| | |
|---|---|
| ***A63B 55/10*** | (2006.01) |
| *A63B 55/00* | (2015.01) |
| *A63B 57/50* | (2015.01) |
| *A63B 69/36* | (2006.01) |
| *A63B 57/20* | (2015.01) |
| *A63B 60/00* | (2015.01) |

(52) U.S. Cl.

CPC ..... *A63B 55/10* (2013.01); *A63B 55/00* (2013.01); *A63B 55/408* (2015.10); *A63B 57/207* (2015.10); *A63B 57/50* (2015.10); *A63B 60/0085* (2020.08); *A63B 69/36* (2013.01); *A63B 2209/08* (2013.01); *A63B 2210/58* (2013.01)

(58) Field of Classification Search

CPC ..... A63B 60/0085; A63B 55/10; A63B 55/00; A63B 2209/08; A63B 2210/58; A63B 55/408; A63B 57/50; A63B 69/36; A63B 57/207; A63B 1/00

See application file for complete search history.

(56) References Cited

U.S. PATENT DOCUMENTS

| | | | | |
|---|---|---|---|---|
| 1,443,230 | A | 1/1923 | Luckett | |
| 2,559,951 | A | 7/1951 | Dunbar et al. | |
| 2,858,868 | A | 11/1958 | Wallace | |
| 2,887,137 | A | 5/1959 | Robb | |
| 3,219,083 | A | 11/1965 | Asquith | |
| 4,063,731 | A | 12/1977 | Kitay | |
| 4,210,334 | A | 7/1980 | Lind | |
| 4,545,579 | A | 10/1985 | McCain | |
| 4,832,338 | A | 5/1989 | Magazzi | |
| 5,437,449 | A | 8/1995 | Zink | |
| 5,496,029 | A * | 3/1996 | Heath | A63B 60/00 473/296 |
| 5,636,754 | A * | 6/1997 | Ennis | A63B 55/10 211/70.2 |

(Continued)

*Primary Examiner* — Stephen L Blau

(74) *Attorney, Agent, or Firm* — Notio Law Group, LLC

(57) ABSTRACT

A pocket-sized, retractable golf club stand that can hold one or more golf clubs is described. The golf club stand includes a magnetic club holder that is attached to a telescoping shaft which is attached to a base including a slidable anchor. During use the anchor is extended and embedded into the ground, the telescoping pole is extended, and clubs are held against the device by the magnetic holder. Upon completion of use, the clubs are removed from the magnetic holder, the telescoping pole is retracted, and the anchor is slidably hidden away. In addition to holding golf clubs the device's anchor may be used for divot repair and the magnetic club holder may be used to secure ball markers.

27 Claims, 6 Drawing Sheets

(56) References Cited

U.S. PATENT DOCUMENTS

| | | | | |
|---|---|---|---|---|
| 6,159,107 | A | 12/2000 | Walton | |
| 6,497,327 | B1 | 12/2002 | Rindfleisch | |
| 6,962,536 | B2 * | 11/2005 | Hall | A24F 13/12 131/241 |
| 8,616,994 | B2 * | 12/2013 | Kwon | A63B 57/20 473/283 |
| D857,138 | S * | 8/2019 | Slyder | D21/796 |
| 2006/0264267 | A1 * | 11/2006 | Fox | A42B 1/0182 473/300 |
| 2008/0146367 | A1 * | 6/2008 | Cruz | A63B 57/207 473/286 |
| 2014/0135142 | A1 * | 5/2014 | David, Sr. | A63B 57/00 473/286 |

* cited by examiner

COMPACT RETRACTABLE GOLF CLUB HOLDER

The present disclosure relates to a device for holding one or more golf clubs, and in particular, the disclosure relates to a device configured to hold one or more golf clubs off the ground when the club(s) are not in use. More particularly, the device is configured so that the user can insert the device into the ground, attach clubs, detach clubs and retrieve the device without the need to bend more than slightly. The disclosure further relates to a device that is retractable while not in use and extendable during use. Still more particularly, the disclosure relates to a device that is compact enough to fit inside the pocket of a golfer while not in use. During use, the device is removed from the pocket of the golfer and moved into an extended position. In its extended position, the device may be inserted into the ground and one or more clubs may be placed against the device and held in place via one or more magnets. In addition to holding unused golf clubs, the device as described can hold ball markers and provide divot repair.

BACKGROUND

The game of golf is a popular sport throughout the world. The popularity of the sport has led to the production and marketing of a wide array of golf accessories. Most accessories are directed to improving a golfer's game, either by improving their score or by enhancing their enjoyment in the game. A significant number of accessories are directed to the protection and transportation of golf clubs, both on and off the course.

As caddies are a vocation associated with professional golfers, most recreational golfers utilize a cart in order to transport their person and clubs around a course. In doing so, their bag, which contains all the necessary clubs, is routinely attached to the cart. During a typical round of golf, a golfer will not detach his golf bag from the cart as it would require significant effort to remove, carry and reattach the bag. Likewise, during a typical round of golf, a golfer may encounter a number of areas, such as around the greens, where golf carts are not allowed in proximity of where subsequent shots will take place. If a golfer has the wrong club, he will have to return to the cart in its position on the cart path to retrieve the correct club. Typically, this circumstance causes golfers to remove one or more clubs from their bag in anticipation of which clubs they might require and carry them to a position proximate their next shot.

When a golfer carries several clubs to, for example, the green, he will often place the clubs that are not in use on the ground in an area outside of the area of play. After the hole is complete, the golfer has to remember to pick up the additional clubs before heading back to the cart, and, not infrequently, a golfer will forget to retrieve the unused clubs. When the forgotten clubs are not needed on the immediately succeeding hole or hole(s), locating those forgotten clubs can be difficult. Furthermore, when playing on a popular course, one or more other golfers may pick up the forgotten clubs and turn them in to lost and found. Having to track down the missing clubs aside, this can leave a golfer without the necessary clubs to favorably complete his round of golf.

Placing clubs directly onto the ground can cause damage to the clubs as they can potentially be stepped upon, driven over with a cart or otherwise physically marred. Moreover, placing clubs directly on the ground causes them to come into direct contact with the elements. For example, during rains or during early morning rounds when dew remains on the grass, clubs can become wet and/or muddy, not only potentially damaging the clubs, but also making subsequent play less pleasant. In addition to natural elements, clubs that are placed on the ground come into contact with pesticides and fertilizers used in the maintenance of the grounds. These chemicals can contaminate the golf club handle and be transferred to the hands of the golfer or his golf glove. Such contact can lead to contamination of multiple club handles and accelerated breakdown of the handle materials thereby requiring their replacement.

In addition to the damage caused to the clubs, repeatedly placing the clubs on the ground and bending over to retrieve clubs can become taxing depending upon the number of holes and/or rounds played. For golfers with disabilities repeated bending to retrieve the unused clubs from the ground may not be practical and may result in the need for additional bulky and cumbersome equipment.

A number of golf stands are available that can be carried and used to support golf clubs during play thereby overcoming the need to place clubs on the ground. Such golf stands include the more traditional bag style holders and tripod legs that are common in golf bags or wheeled carts. While such stands address some of the issued discussed above and can provide certain advantages, they are cumbersome and bulky to use and must be detached and reattached to a golf bag or cart at each hole.

Aside from more traditional and bulky golf stands, other accessories have been developed that address one or more of the issues discussed above. One accessory developed to hold clubs off the ground is a pole that may be inserted into the ground to which clubs may be attached. This holder has to be long enough to protrude from a golf bag or it is difficult to find and retrieve. The pole includes a club holding hook at one end and a spike for insertion into the ground on the other. During use, the pole is removed from the golf bag, inserted into the ground, and clubs are attached thereto. Upon completion of the hole, the clubs are retrieved, and the pole is removed from the ground and carried back and replaced into the golf bag. While this accessory does help keep the clubs upright, it creates a burdensome additional piece of equipment. When temporary club stands or holders become burdensome it is far less likely that the golfer will routinely use the device. When the device is left in the golf cart, golfers tend to revert to the default of laying the clubs on the ground.

Another device which attempts to address the issues discussed without being bulky or burdensome is a tool that may be inserted into the ground, but which protrudes from the ground by only a few inches. The clubs may be lain across the device to keep them out of the grass and water. This device while being compact and keeping clubs off the ground leaves the clubs in a prone position along the ground making them no easier to see then they are when they are laid upon the ground and therefore just as likely to be forgotten. In addition, the device continues to require repeated bending to retrieve unused clubs. None of the prior art devices hold one or more golf clubs while providing the ease of use of the device as described herein.

SUMMARY OF THE INVENTION

The device as described is a compact multi-tool for the recreational golfer capable of being his divot repair tool, ball marker holder and club stand. The device is a golf club holder and, as described, is easily anchored into the ground and can hold one or more golf clubs in a substantially upright position. The device, in its retracted form, can be easily attachment to a golf bag or stored within the golfer's pocket in a manner that doesn't interfere with their round of golf. During use, the device is extended and then anchored into the ground by simple foot pressure from the golfer. Golf clubs can then be stood against the device and held in place by a magnetic member at the top of the device. Once play is complete, the unused clubs are easy to see and collect. The device can then be quickly pulled from the ground and retracted and again placed inside the golfer's pocket or attached to the golf bag.

In one embodiment, the disclosure relates to a retractable stand for holding a golf club comprising, an upper element comprising a holder for securing a golf club; a collapsible shaft connected between the upper element and a bottom element; the bottom element comprising an anchor for securing the stand in the ground, wherein at least one of the upper element or the bottom element is configured to house the collapsible shaft when in a retracted position.

In another embodiment, the disclosure relates to a telescoping golf club holder comprising, an upper element comprising a magnetic holder for securing golf clubs; a bottom element comprising an anchor for securing the holder into the ground, wherein the anchor is slidably located in a groove in the bottom element and further comprises a handle on an upper portion of the anchor; and a telescoping shaft affixed between the upper element and the bottom element.

In yet another embodiment, the disclosure relates to a method of holding golf clubs with the device as described comprising, moving an upper element and a bottom element apart to expose and extend a telescoping shaft; sliding an anchor member downward to expose it from the end of the device using a handle located on an upper part of the anchor, and placing the anchor against the ground; stepping on the handle to secure the anchor into the ground; and placing one or more clubs against a magnetic holder on the upper element.

In still a further embodiment, the disclosure relates to a telescoping golf club holder comprising, an upper element comprising a magnetic holder for securing golf clubs; a bottom element comprising an anchor for securing the holder into the ground, wherein the anchor is slidably located in a groove in the bottom element and further comprises a handle on an upper portion of the anchor and a locking ring for securing the anchor; and a telescoping shaft affixed between the upper element and the bottom element.

Figure 1:
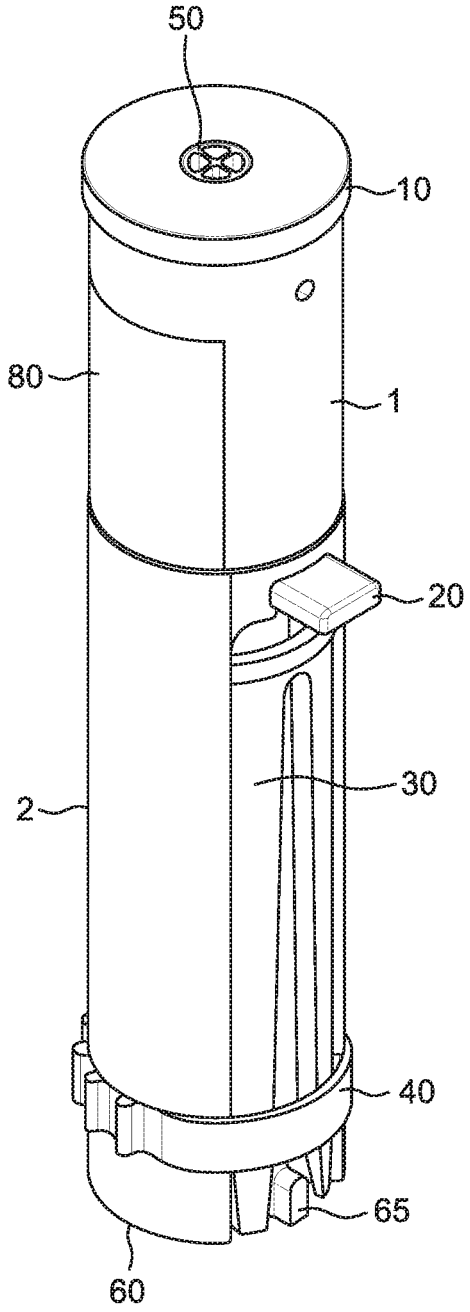
FIG. 1 illustrates a perspective, top, front, view of one embodiment of the golf club stand in its fully retracted position.

The drawing figures are not necessarily to scale. Certain features of the embodiments may be shown exaggerated in scale or in somewhat schematic form and some details of conventional elements may not be shown in the interest of clarity and conciseness.

DESCRIPTION

The following discussion is directed to various embodiments of the invention. Although one or more of these embodiments may be preferred, the embodiments disclosed should not be interpreted, or otherwise used, as limiting the scope of the disclosure, including the claims. It is to be fully recognized that the different teachings of the embodiments discussed below may be employed separately or in any suitable combination to produce desired results. In addition, one skilled in the art will understand that the following description has broad application, and the discussion of any embodiment is meant to only to be exemplary of that embodiment, and not intended to intimate that the claims should be construed as limited to that embodiment.

Certain terms are used throughout the following description and claims to refer to particular features or components. As one skilled in the art will appreciate, different persons may refer to the same feature or component by different names. This document does not intend to distinguish between components or features that differ in name but not structure or function.

In the following discussion and in the claims, the terms "including", "comprising", and "is" are used in an open-ended fashion, and thus should be interpreted to mean "including, but not limited to."

As used herein "club holder" and "club stand" refer to the retractable device described herein and are used interchangeably unless indicated otherwise.

As used herein "magnetic element" and "magnetic holder" refer to the magnetic portion of the device that interacts with the golf club to retain the club in an upright position and are used interchangeably unless indicated otherwise.

During a typical round of golf, a golfer will carry a divot repair tool in his pocket to assure the grounds are left in the best available condition. The multi-utility tool that is described herein replaces that divot repair tool making it possible for a golfer to have the benefit of the club stand without the need to carry a single additional piece of equipment. Additionally, the multi-utility tool as described is sized so that the golfer will find it no more cumbersome than a repair tool he commonly carries. While the description will focus on the golf stand capabilities of the tool, providing divot repair and a simple place to carry a ball marker are features of the devices as described.

The golf club stand as described provides an easy and efficient way to hold unused golf clubs in an area proximate to play and in an easy to reach fashion. The golf club stand uses a retractable shaft that can, with little effort, be secured to the ground allowing golf clubs to be placed against the stand in a secure manner. Because the clubs stand upright, they may be conveniently retrieved without the user having to bend down. Further, because the clubs stand upright, they are more easily seen by the golfer when leaving the green and are less likely to be forgotten. The golf club stand is configured so that the shaft is easy to collapse into a compact device that can be carried, for example, in a pants pocket. Such an arrangement allows for easy transport without hindering the players capacity to enjoy their round of golf.

Reference will now be made to the examples of the disclosed embodiments which are illustrated in the accompanying drawings. Where convenient the same reference numerals will be used throughout the drawings to refer to the same parts or like parts.

Figure 2:
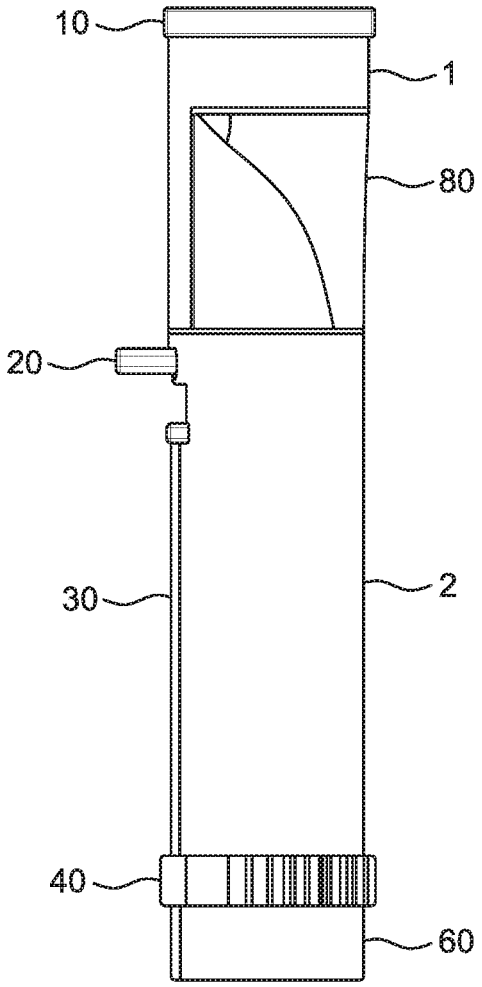
FIG. 2 illustrates a side view of one embodiment of the golf club stand in its fully retracted position.
Figure 3:
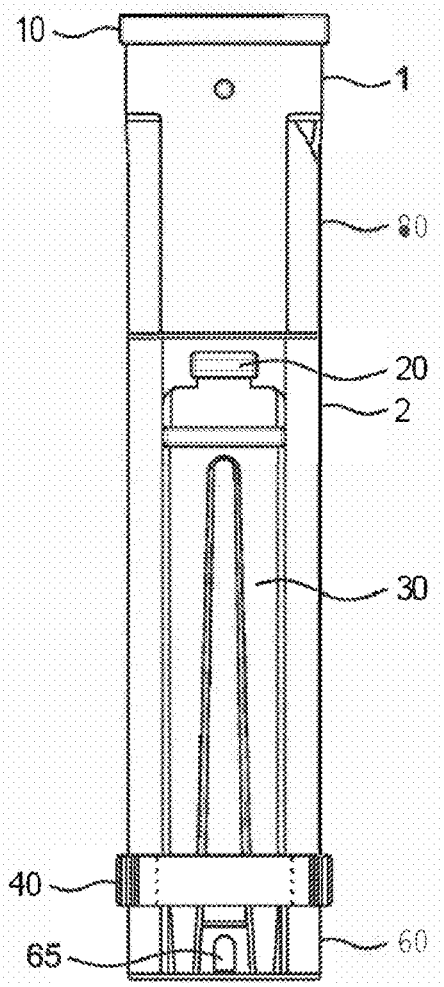
FIG. 3 represents a front view of one embodiment of the golf club stand in its fully retracted position.

FIGS. 1 to 3 illustrate one embodiment of the golf club holder as described. The club holder seen in FIGS. 1 to 3 is shown in a retracted arrangement. An upper element 1 has attached thereto a magnetic element 10 which is used to secure golf clubs. The metal shaft of a golf club is placed against the magnetic element 10 with the head of the club resting on the ground or held above the ground. The magnetic element 10 holds the golf club in an upright position with the club grip extending upward. The upper element 1 is connected via a collapsible shaft (seen in FIG. 5) to a bottom element 2. The bottom element 2 includes an anchor 30 which is used to secure the device into the ground. In the embodiment shown, the anchor 30 is located in a recessed track in the bottom element 2. The anchor 30 is slidable and can be raised and lowered within the recessed track by handle 20. The anchor 30 is held in place by a locking ring 40. In the embodiment shown, the anchor 30 is forked. During use of the device, the anchor 30 can be slidably lowered to extend beyond the end of the device. In this extended position, the anchor 30 can be used to secure the device into the ground. According to one embodiment, the handle 20 can be used as a peddle by the golfer to apply pressure to the anchor 30 causing the anchor 30 to sink into the ground.

In the embodiment shown in FIG. 1, the bottom element 2 is secured to a base 60 which rests upon the ground during use. The base 60 and the bottom element 2 are configured to create a track into which the locking ring 40 is secured. In the embodiment shown, the base 60 has a pair of grooves that line up with the recessed track in the bottom element 2. When the anchor 30 is lowered out of the device, the tines of the fork of the anchor 30 ride within the grooves on both the bottom element 2 and the base 60 until the handle 20 connects with the locking ring 40. In embodiments without a locking ring 40, the anchor 30 would continue to be lowered until it connects with the stopper element 65 seen in FIGS. 1 and 3.

In the embodiment shown in FIG. 1, the magnetic element 10 is secured to the top of the upper element by a plastic ring 50 located in an opening in the magnetic at the top thereof. The magnetic element 10 can be seen to protrude slightly from beyond the edge of the upper element 1. Such an arrangement assures that the club handle will contact the magnetic material regardless of where upon the device the club is laid.

While the magnetic element 10 is shown atop the upper element 1, the magnetic material may be included in the upper element 1 in any art recognized manner. For example, the magnetic material could be attached around or embedded into the upper element 1. According to one embodiment, the upper element 1, can be made from magnetic material. According to another embodiment, the magnetic material may be formed in a ring along the top edge of the upper element 1. In both of these alternatives, the club would be attracted to and attach to the upper element 1 regardless of the placement of the club against the device. When a single magnetic element holds multiple clubs, removal of one club can cause the second club to also come away from the magnet. In this instance, the second club will have to be contacted again with the magnet to reattach the second club. According to one embodiment, the magnet on the top of the upper element may be sectioned into two or three sections each capable of holding a single club without demagnetization when another club is removed. For embodiments intended to hold multiple clubs, magnetic material may be applied to the upper element 1 in one or more individualized locations around or on top of the upper element 1.

As seen in FIGS. 1 and 3, the locking ring 40 comprises a series of bevels that can engage with the anchor 30 locking the anchor 30 in place after it is extended. While the anchor 30 is retracted, the smooth front of the locking ring 40 covers the anchor 30 allowing the anchor to be slidably moved into or out of the bottom element 2. When the anchor 30 is extended, the locking ring 40 can be rotated around the base so that the bevels engage with the anchor 30 thereby locking the anchor 30 in its extended position.

During use, the upper element 1 and bottom element 2 are manually drawn away from one another to expose the collapsible shaft 3 after engaging retention mechanism 80. According to one embodiment, the retention mechanism 80 is a simple push button mechanism that releases the upper element 1 from the bottom element 2 allowing the two parts to be drawn apart, e.g., a magnetic clasp or a physical tab. Any art recognized locking and release mechanism can be used as the retention mechanism 80. According to one embodiment, the retention mechanism works like the push button on an umbrella, releasing the telescoping shaft and beginning the process of extending the shaft. According to another embodiment, the upper element 1 has not latching mechanism and the collapsible shaft 3 is moved manually. In this embodiment, upper element 1 may be smooth or have one or more decorative elements.

Figure 4:
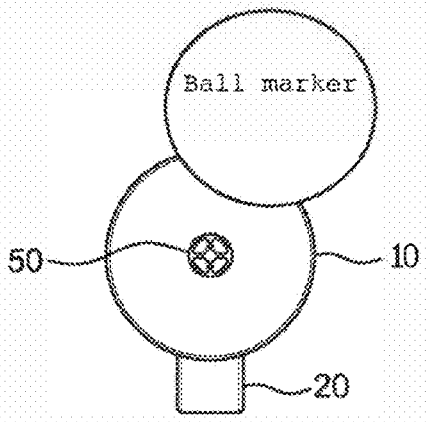
FIG. 4 illustrates a top plan view of one embodiment of the golf club stand.

FIG. 4 is a top view of the golf club stand showing the magnetic holder 10, the anchor handle 20 and the magnet coupler 50. The profile of the device as seen from above is the same in both the retracted and extended positions. In the embodiment shown, the magnetic holder 10 extends beyond the edges of the upper element 1 making the holder 10 diameter the widest point on the device aside from the handle 20. A ball marker that may be carried on the top of the device can be seen partially covering the magnet 10.

Figure 5A:
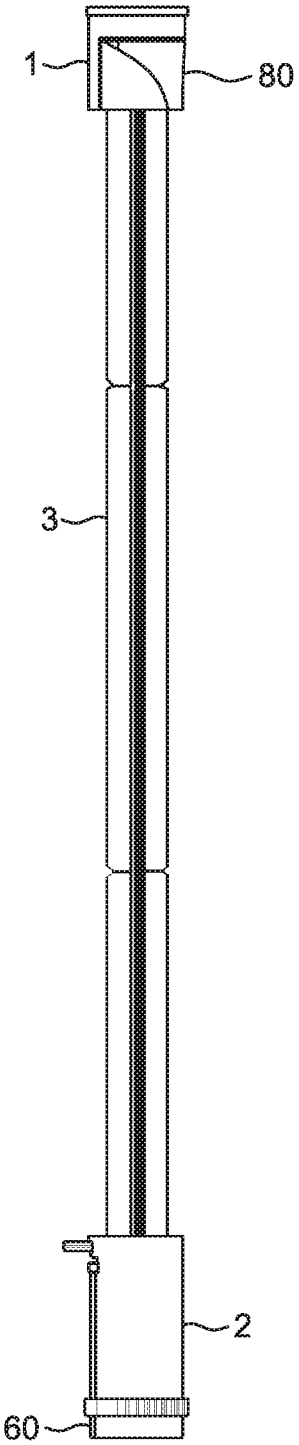
FIG. 5A illustrates a side view of one embodiment of the golf club stand in its fully extended position.
Figure 5B:
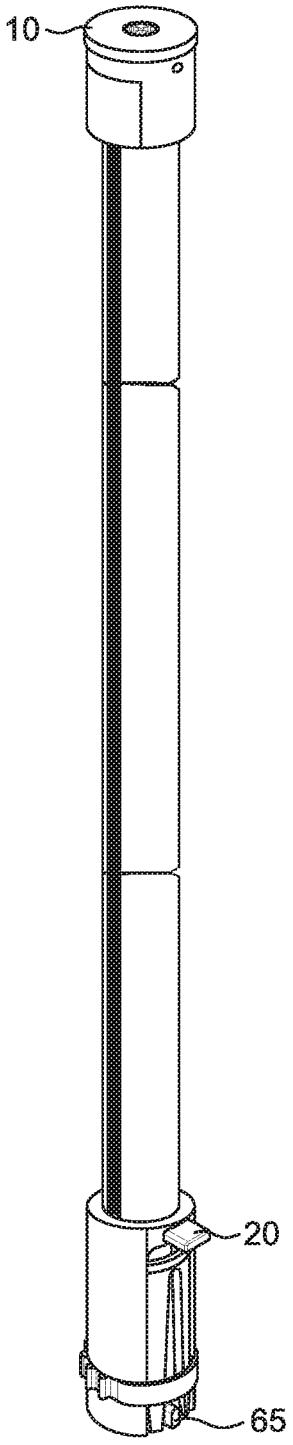
FIG. 5B illustrates a top, front, perspective view of one embodiment of the golf club stand in its fully extended position.
Figure 5C:
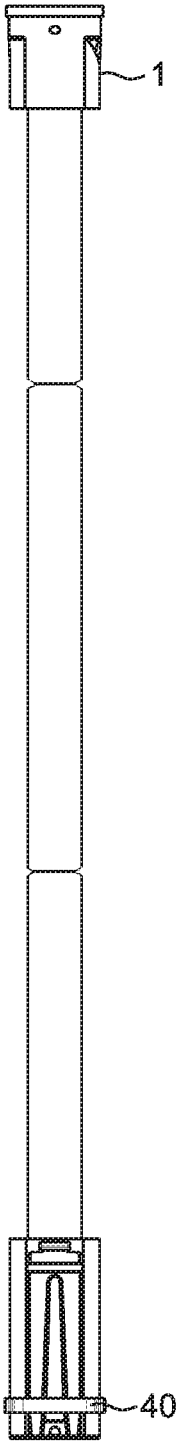
FIG. 5C illustrates a front view of one embodiment of the golf club stand in its fully extended position.

FIGS. 5A, 5B and 5C illustrate the embodiment of FIGS. 1 to 3 in an extended position. The upper element 1 including the magnetic holder 10 is attached to a first end of a telescoping shaft 3. The bottom element 2 including the anchor is attached to the opposite end of the telescoping shaft 3. In the embodiment shown, the shaft 3 is exposed by pulling the upper element 1 away from the bottom element 2. In the embodiment shown the shaft 3 includes a groove that engages with a guide member (not shown) thereby keeping the telescoping member from rotating.

According to one embodiment, the telescoping shaft 3 of the device can be made of metal and telescope in a manner just like an umbrella handle extends. According to this embodiment, the telescoping shaft 3 is metal and has from 3 to 8 sections that fit within one another and are housed in the bottom element 2. During use, the telescoping shaft may be manually pulled out or may use a push button mechanism, just as an umbrella handle would. To close the device, the sections are pushed back together into a retracted position. According to another embodiment, the telescoping shaft 3 is made from one or more hard plastics, sectioned into 4 to 8 units and provided with sufficient friction to keep the shaft extended during use.

According to another embodiment, the shaft is made from one or more plastic materials that are sectioned with each section being held in an extended position by one or more locking mechanisms.

According to yet another embodiment, the extended shaft may include one or more telescoping mechanisms, for example, springs that are covered in a lightweight plastic. The spring mechanisms are chosen to provide sufficient structural strength to hold the clubs during use, but are no stronger than are needed making them easy to collapse with a bit of pressure from the golfer.

According to another embodiment, the collapsible shaft further comprises as one or more locking mechanisms that prevent the shaft from retracting during use. Locking mechanisms can include latches, clasps, tabs, twists, high friction zones or any other art recognized means for preventing the shaft from retracting during use.

Figure 6:
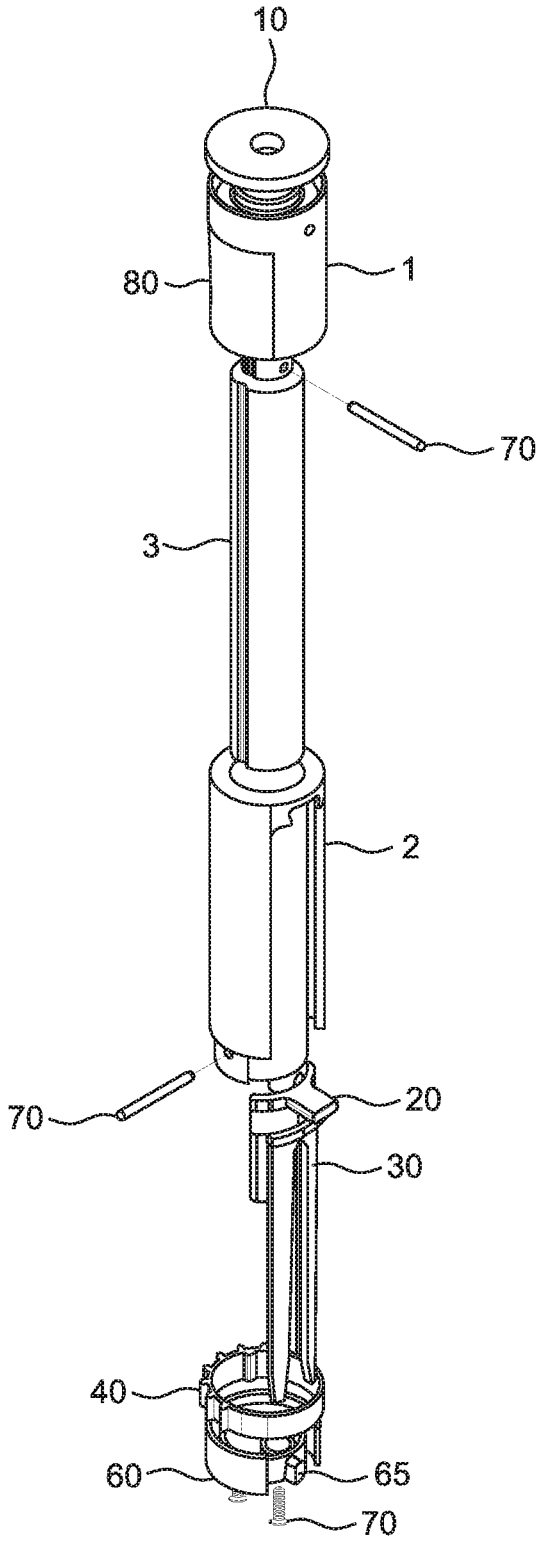
FIG. 6 illustrates an exploded, front, perspective, view of the golf club stand.

FIG. 6 is an exploded view of the golf club holder of FIG. 1. As seen in FIG. 6, the base 60 is secured to the bottom element 2 by fasteners 70. The fasteners 70 may be screws, rivets or any art recognized fasteners. The locking ring 40 is placed outside the anchor 30 in a groove formed between the base 60 and the bottom element 2. In the embodiment shown, the anchor handle 20 is aligned with, but not coupled to the anchor 30. The anchor 30 fits slidably into the recess on the bottom element 2. At least one end of the collapsible shaft 3 fits within bottom element 2 and is secured to the bottom element 2 by fastener 70. The opposite end of collapsible shaft 3 is fitted into the upper element 1 and is also secured by a fastener 70. Finally, the magnetic holder 10 is secured to the top of the upper element 1.

While the device seen in FIGS. 1-5 is circular in cross-section, it will be readily apparent to the skilled artisan that the shape of the cross-section of the device may be changed without any appreciable change in function. According to one embodiment, the device may be square, rectangular or oval.

Figure 7A:
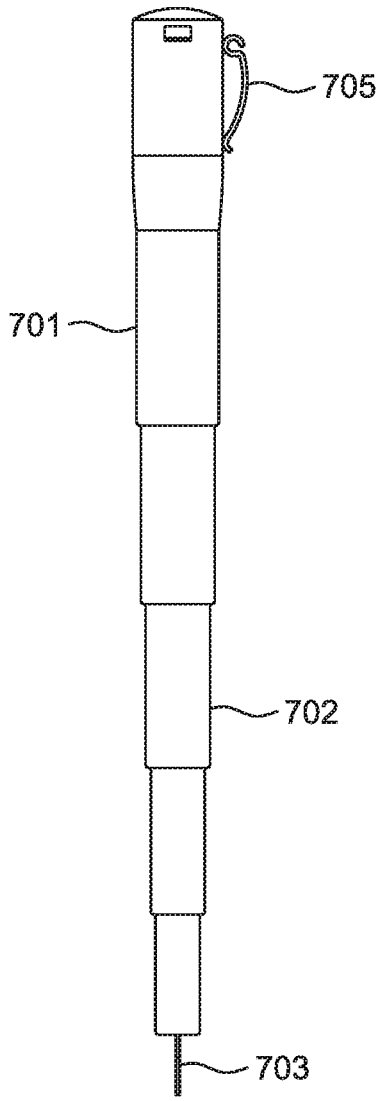
FIG. 7A illustrates a side view of another embodiment of the golf club stand.
Figure 7B:
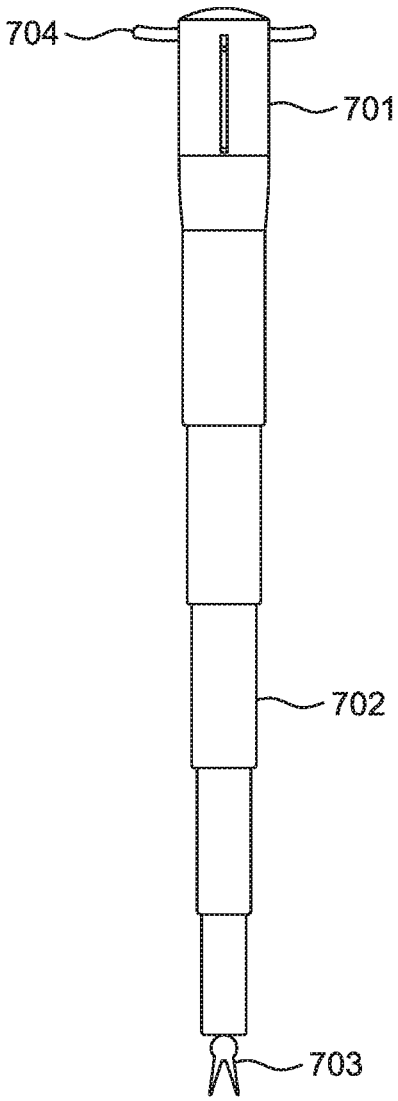
FIG. 7B illustrates a front view of another embodiment of a golf club stand.

FIGS. 7A and 7B illustrates a second embodiment of the golf club holder as described. While not as compact as the first embodiment, this embodiment nonetheless provides a retractable, lightweight anchored holder for keeping golf clubs in an upright position. According to this embodiment, the golf club stand comprises an upper portion which may be integral with or attached to a telescoping shaft. The upper portion can comprise one or more club rests 704 or holders 705 for attaching the clubs to the device or attaching the device to a golf bag. While the holders 705 are physical formations for attaching the golf club, this embodiment may also use a magnetic material capable of holding the clubs in place magnetically.

The shaft as seen in FIGS. 7A and 7B can comprises one or more sections including a top element 701 configured to hold the golf clubs and a lower shaft 702 which includes the anchor 703 and telescopes downward during use. In this embodiment, the shaft could also be unitary and co-formed with either or both of the club holder 701 and the anchor 703. This embodiment also contemplates the use of a magnetic strip or button that can be used to hold one or more ball markers.

During use, the shaft 702 is extended either manually or via a spring action push button (not shown). After extension, the telescoping shaft 702 has a catch located at the bottom that maintains the device in the extended position. Once the telescoping shaft 702 is extended and latched, the anchor 703 may be pushed into the ground. The golf club is attached to club holders 705 or rests against club rests 704. When play is complete, the clubs are collected, the catch is released, and the device is retracted, either manually, or again by the push of a button when a spring action mechanism is employed.

This embodiment is not as compact as the first embodiment and may be too large to fit within the pocket of a golfer. In a preferred embodiment, this device remains under 6 inches long making it easy to transport and use. In one embodiment, the golf club stand is fitted with a clip or carabiner that can be used to secure the device to the outside of the golf bag.

While the golf club stand has described with respect to specific embodiments, changes and alternative embodiments are contemplated herein and described below.

Either in the embodiments described above or in other embodiments, the anchor may be any shape that will adequately secure the device to the ground. For example, the anchor may be a single spike, a multi-tined fork, a sharpened plate or the like. Preferred configurations are those that provide the best support and the easiest removal. According to one embodiment, the anchor is a spike or fork having a length of from about 1 to about 3 inches, for example, a length of from about 1.5 to about 2 inches. Anchors may or may not have handles for extension. When anchors are equipped with one or more handles, the handle(s) may be integral with the anchor or they may be separate elements that are coupled to or aligned with the anchor.

The anchor may or may not be secured by a locking mechanism; however, when secured, the anchor may be secured by any art recognized locking mechanism. The locking mechanism may be a pin, elastic member, or any traditional locking mechanism or clasp. The lock may be securable in both the retracted and extended positions or may be engaged only in the extended position. According to one embodiment, the locking mechanism comprises a clasp that may be engaged with either the anchor or the anchor handle to maintain the anchor in the extended position.

While the primary embodiment includes a base, a base is not necessary in all embodiments. In one embodiment without a base, the bottom element 2 may act as a base and the locking ring 40 may be carried by a track formed into the bottom element 2.

The extension and retraction of the collapsible shaft in the club holder may be carried out by pulling, pushing or may be automated, for example, through the use of spring action.

While the holder on the upper element may be magnetic in the primary embodiment, the use of alternatives for physically grasping the club or providing space for the club to lean would also be appropriate. According to one embodiment, the holder is a pair or arms that flex and can wrap around the shaft of the golf club. According to another embodiment, the arms are elongated and slightly curved and the shaft of the golf club will rest within the curve on the arms. According to yet another embodiment, the holder may be an elastic member that is placed over the club handle.

The collapsible shaft may be a telescoping shaft or can be any collapsible extension member that can support the weight of one or more golf clubs. The collapsible shaft is carried by either or both of the upper element 1 or the bottom element 2 and should fit appropriately within the defined cavity without substantial pressure having to be exerted on the device to close it.

While the device is described for perpendicular insertion into the ground, any angle of insertion may be used. In some instances, depending upon the hardness of the ground, the angle of insertion may be changed to more easily accommodate the ground or landscape within which the device will be used.

The individual elements of the device can be made of any material suitable to provide the desired function for that element. For ease of manufacture and cost, the materials of construction may be metal, plastic, rubber, polymers and the like.

The golf club holder as described is easy to engage, compact during transport and highly visible when exiting an area of play. While the following discussion relates to a stand having certain preferred elements, the device is in no way limited to these elements and the use of the device would be modified accordingly.

First, the device may be detached from a golf bag, taken from a pants pocket or from a pocket on the golf bag. According to preferred embodiments, the device is carried in the pocket of the golfer or magnetically attached to a metal ring or member on the outside of the golf bag. During use, the user extends the collapsible shaft (automated in one embodiment, or manually in other embodiments), allowing the device to be from about 2 to about 10 times the size of the device in its retracted position. The exact measurements can vary so long as once extended, the shaft is tall enough and sturdy enough to hold the weight of one or more clubs. According to one embodiment, the device is from about 3 to about 6 inches long in its retracted position and from about 20 to about 40 inches long in its extended position.

The shaft, when extended, can include a catch, a latch or a clasp to secure the devise in the extended position. In one embodiment, the latch may be released via a simple push button or a spring actuated release. Any art recognized manner for maintaining the telescoping shaft in an extended position can be used with the device as described.

Once the collapsible shaft is extended, the golfer may slide the anchor downward and rotate the locking mechanism to keep the anchor in its extended position. The golfer may then place the device against the ground and step lightly on the handle used to slide out the anchor causing the anchor to embed into the ground. Once the device is embedded in the ground and standing upright, the golfer may attach his unused clubs to the device by contacting the metal shafts with the magnetic holder.

Upon completion of the shot(s), the golfer will remove the clubs from the magnetic holder and grasping the device, pull it from the ground. The locking mechanism may be rotated releasing the anchor allowing the golfer to slide the anchor back into the bottom element using the handle that had previously been used as a peddle. The golfer will release a latch if one is being used and slide the two ends of the device inward to force the collapsible shaft back into the upper element and/or the bottom element depending upon the configuration of the device. Once its retracted position is reached, the golfer may place the device into his pocket or attach it his golf bag before moving on to the next hole.

While the device has been described in relation to its use as a golf club holder, the device has other utilities including carrying ball markers, correcting divots and acting as a training tool. In its retracted position, the anchor can be slidably released downward and secured by rotation of the locking ring. The extended anchor can then be inserted into the ground around a divot and rotated, displacing earth to rise up and partially fill the divot. In its fully or partially extended position, with the collapsible shaft exposed, the device can be used as an alignment device on the practice range. Golfers can lay the device on the ground utilizing it as a guide for the direction of their swing in accordance with a number of training techniques.

Other embodiments of the present invention can include alternative variations. These and other variations and modifications will become apparent to those skilled in the art once the above disclosure is fully appreciated. It is intended that the following claims be interpreted to embrace all such variations and modifications.

I claim:

1. A retractable stand for holding a golf club comprising:
- an upper element comprising a holder for securing a golf club;
- a collapsible shaft connected between the upper element and a bottom element, the bottom element comprising an anchor for securing the stand in the ground,
- wherein at least one of the upper element or the bottom element is configured to house the collapsible shaft when in a retracted position and further wherein the holder is less than 5 inches in a retracted position.

2. The stand of claim 1, wherein the holder for securing a golf club is chosen from a magnet, a clasp or a pair or arms.

3. The stand of claim 1, wherein the holder is magnetic.

4. The stand of claim 1, wherein the holder comprises a magnetic material affixed to the upper element and wherein the magnetic material extends beyond an edge of the upper element.

5. The stand of claim 1, wherein the collapsible shaft is telescoping.

6. The stand of claim 1, wherein the anchor for securing the stand in the ground is forked.

7. The stand of claim 1, wherein the anchor is secured in both a retracted and extended position by a locking ring.

8. The stand of claim 1, wherein the anchor further comprises a handle for raising and lowering the anchor.

9. The stand of claim 1, wherein the bottom member has a depressed track into which the anchor slides.

10. The stand of claim 1, wherein the upper and bottom elements are attached to a base.

11. The stand of claim 1, wherein the holder is greater than 20 inches long when in the extended configuration.

12. The stand of claim 1, wherein the collapsible shaft is a telescoping pole with a groove to prevent rotation of the shaft during extension.

13. A telescoping golf club holder comprising:
- an upper element comprising a magnetic holder for securing golf clubs;
- a bottom element comprising an anchor for securing the holder into the ground, wherein the anchor is slidably located in a groove in the bottom element and further comprises a handle on an upper portion of the anchor; and
- a telescoping shaft affixed between the upper element and the bottom element.

14. The stand of claim 13, wherein the magnetic holder is affixed to the upper element and wherein the holder extends beyond at least one edge of the upper element.

15. The stand of claim 13, wherein the anchor is secured in both a retracted and extended position by a locking ring.

16. A method of holding golf clubs with the device of claim 13, comprising:
- moving the upper element and the bottom element apart to expose and extend the telescoping shaft;
- sliding the anchor member downward with the handle and placing the anchor against the ground;
- stepping on the handle to secure the anchor into the ground; and placing one or more clubs against the magnetic holder on the upper element.

17. The method of claim 16, further comprising unlocking a locking ring, by rotation of the ring prior to sliding the anchor member downward along the bottom element.

18. The method of claim 16, further comprising:

removing any clubs from the magnetic holder;

sliding the anchor member upward into the bottom element;

rotating the locking ring to lock the anchor in place; and moving the upper element and bottom element together to retract the telescoping shaft.

19. A retractable stand for holding a golf club comprising:

an upper element comprising a holder for securing a golf club;

a collapsible shaft connected between the upper element and a bottom element, the bottom element comprising an anchor for securing the stand in the ground, wherein at least one of the upper element or the bottom element is configured to house the collapsible shaft when in a retracted position, further wherein the holder comprises a magnetic material affixed to the upper element and wherein the magnetic material extends beyond an edge of the upper element.

20. The stand of claim 19, wherein the collapsible shaft is telescoping.

21. The stand of claim 19, wherein the anchor for securing the stand in the ground is forked.

22. The stand of claim 19, wherein the anchor is secured in both a retracted and extended position by a locking ring.

23. The stand of claim 19, wherein the anchor further comprises a handle for raising and lowering the anchor.

24. The stand of claim 19, wherein the bottom member has a depressed track into which the anchor slides.

25. The stand of claim 19, wherein the upper and lower bottom elements are attached to a base.

26. The stand of claim 19, wherein the holder is greater than 20 inches long when in the extended configuration.

27. The stand of claim 19, wherein the collapsible shaft is a telescoping pole with a groove to prevent rotation of the shaft during extension.

* * * * *